US005550617A

United States Patent [19]

Odagawa et al.

[11] Patent Number: 5,550,617

[45] Date of Patent: Aug. 27, 1996

[54] PROCESS CARTRIDGE AND IMAGE FORMING APPARATUS

[75] Inventors: Kazuyoshi Odagawa, Koshigaya; Shinichi Sasaki, Fujisawa, both of Japan

[73] Assignee: Canon Kabushiki Kaisha, Tokyo, Japan

[21] Appl. No.: 381,339

[22] Filed: Jan. 31, 1995

[30] Foreign Application Priority Data

Jan. 31, 1994 [JP] Japan ..... 6-009743

[51] Int. Cl.[6] ..... G03G 21/18

[52] U.S. Cl. ..... 355/210; 355/211; 355/219; 355/245

[58] Field of Search ..... 355/200, 210, 355/211, 299, 251, 219; 347/152

[56] References Cited

U.S. PATENT DOCUMENTS

| | | | |
|---|---|---|---|
| 4,258,113 | 3/1981 | Kuehnle | 355/211 |
| 4,563,978 | 1/1986 | Nakamura et al. | 355/245 |
| 5,126,800 | 6/1992 | Shishido et al. | 355/211 |
| 5,151,734 | 9/1992 | Tsuda et al. | 355/200 |
| 5,223,893 | 6/1993 | Ikemoto et al. | 355/200 |
| 5,345,294 | 9/1994 | Nomura et al. | 355/200 |
| 5,383,011 | 1/1995 | Numagami et al. | 355/299 |
| 5,446,525 | 8/1995 | Kobayashi | 355/210 |

*Primary Examiner*—Joan H. Pendegrass

*Attorney, Agent, or Firm*—Fitzpatrick, Cella, Harper & Scinto

[57] ABSTRACT

The present invention provides a process cartridge including an electrophotographic photosensitive member and process means acting on the electrophotographic phtosensitive member. Main parts constituting the photosensitive member and the process means are made of synthetic resin.

55 Claims, 9 Drawing Sheets

PROCESS CARTRIDGE AND IMAGE FORMING APPARATUS

BACKGROUND OF THE INVENTION

1. Field of the Invention

The present invention relates to a process cartridge and an image forming apparatus to which such a process cartridge can removably be mounted.

Here, the process cartridge is a unit which includes an electrophotographic photosensitive member, and a charge means, a developing means or a cleaning means and which can removably be mounted on the image forming apparatus, or a unit which includes an electrophotographic photosensitive member, and at least one of a charge means, a developing means and a cleaning means and which can removably be mounted on the image forming apparatus, or a unit which includes an electrophotographic photosensitive member, and at least a developing means and which can removably be mounted on the image forming apparatus.

Further, the image forming apparatus is an apparatus for forming an image on a recording medium by utilizing an electrophotographic process, such as an electrophotographic copying machine, an electrophotographic printer (for example, laser beam printer, LED printer and the like), an electrophotographic word processor and the like.

2. Related Background Art

In known electrophotographic image forming apparatuses such as printers, a latent image is formed on an electrophotographic photosensitive member uniformly charged by means of a charger by selectively exposing the photosensitive member in response to image information. The latent image is developed with toner to visualize the latent image as a toner image. Then, the toner image is transferred onto a recording medium to form an image on the recording medium.

On the other hand, there has been a process cartridge wherein an electrophotographic photosensitive member, a charger, a developing device and a cleaning device are integrally assembled together as a unit which can removably be mounted on an image forming apparatus, thereby permitting replacement of the photosensitive member or the like, a service life of which was expired, by a new one, and facilitating maintenance.

The present invention further improves the conventional process cartridges.

SUMMARY OF THE INVENTION

An object of the present invention is to provide a process cartridge and an image forming apparatus in which recycling can easily be effected.

Another object of the present invention is to provide a process cartridge and an image forming apparatus which can easily be disassembled.

A further object of the present invention is to provide a process cartridge and an image forming apparatus in which a larger number of parts made of the same material can be used.

A still further object of the present invention is to provide a process cartridge and an image forming apparatus in which an electrophotographic photosensitive member and at least one process means acting on this photosensitive member, and main parts or members are made of synthetic resin.

The other object of the present invention is to provide a process cartridge and an image forming apparatus wherein, regarding recycle of the process cartridge, parts which can be recycled are mainly made of synthetic resin so that reproduction of material can be facilitated, thereby improving efficiency of the recycle and achieving a decrease in cost.

DETAILED DESCRIPTION OF THE PREFERRED EMBODIMENTS

The present invention will now be fully explained in connection with embodiments thereof with reference to the accompanying drawings.

First Embodiment

Figure 1:
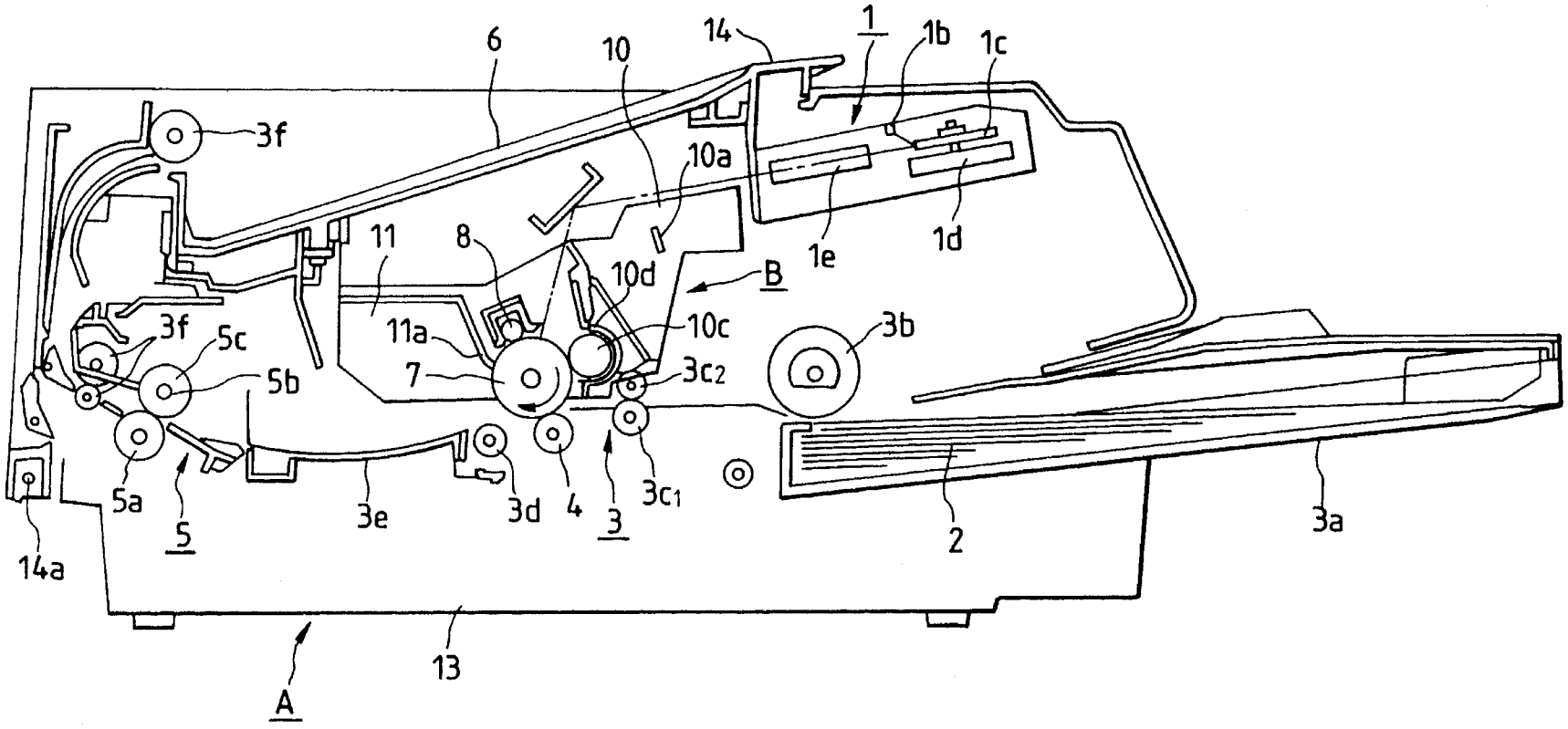
FIG. 1 is an elevational sectional view of an image forming apparatus to which a process cartridge according to a preferred embodiment can removably be mounted.
Figure 2:
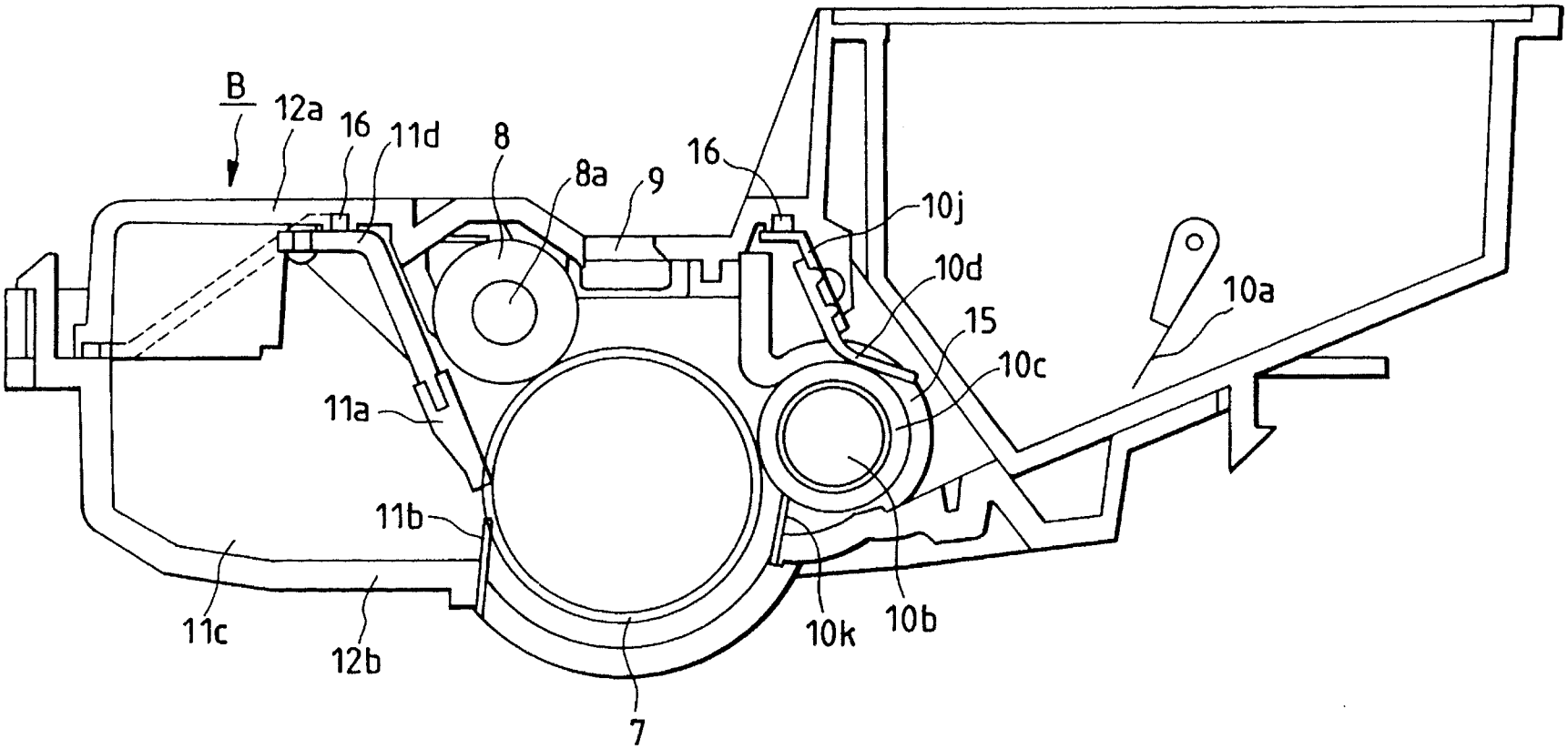
FIG. 2 is a sectional view of the process cartridge.
Figure 3:
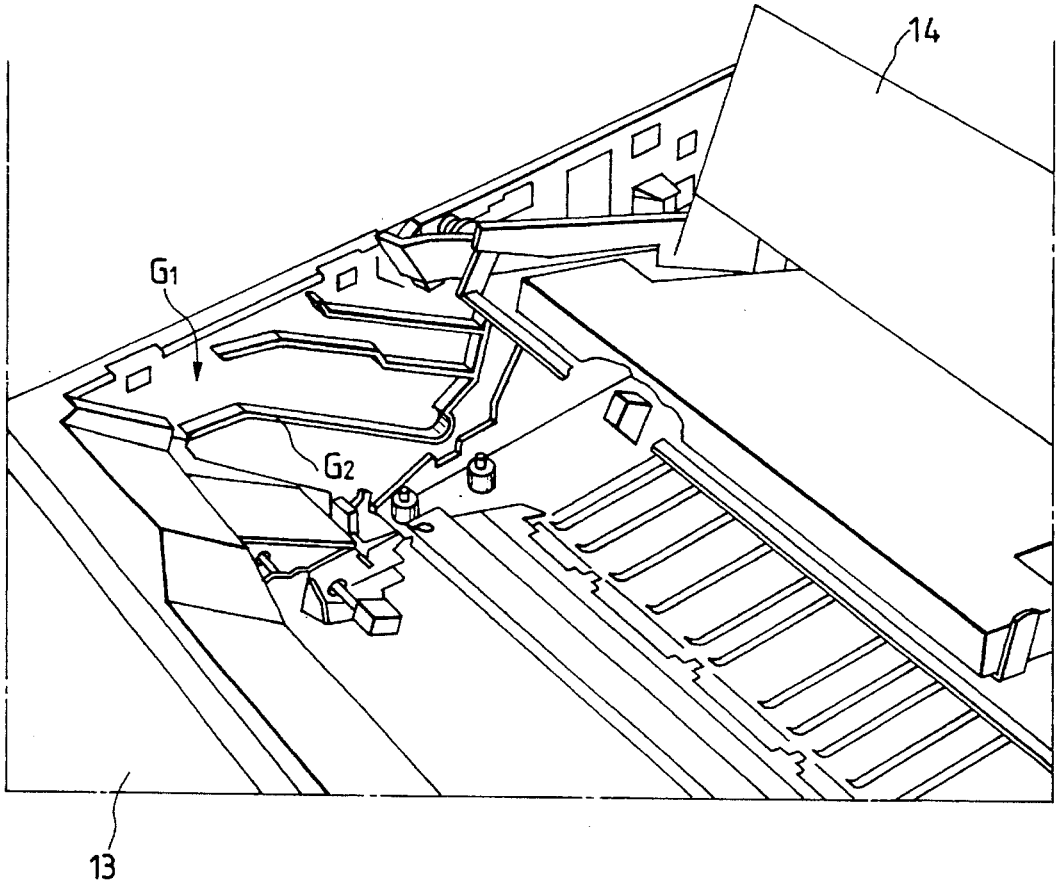
FIG. 3 is a perspective view of a cartridge mounting portion.

FIG. 1 is an elevational sectional view of an electrophotographic printer (laser beam printer) as an electrophotographic image forming apparatus to which a process cartridge according to a preferred embodiment can be removably be mounted, FIG. 2 is a schematic sectional view of the process cartridge, and FIG. 3 is a perspective view of a cartridge mounting portion. First of all, the entire construction of the image forming apparatus to which the process cartridge is mounted will be explained, and then various of the image forming apparatus A and the process cartridge B will be explained.

Entire Construction

As shown in FIG. 1, in the electrophotographic image forming apparatus (laser beam printer) A, information light from an optical system 1 is illuminated on a drum-shaped electrophotographic photosensitive member in response to image information to form a latent image on the photosensitive member. The latent image is then developed as a developer (referred to as "toner" hereinafter) image. On the other hand, a recording medium 2 is conveyed by a convey means 3 synchronously with the formation of the toner image so that the toner image formed on the photosensitive member can be transferred onto the recording medium 2 by a transfer means 4. Thereafter, the recording medium 2 is sent to a fixing means 5, where the toner image is fixed to the recording medium. Then, the recording medium is discharged to a discharge portion 6.

As shown in FIG. 2, in the process cartridge B constituting an image forming portion, as the photosensitive member (photosensitive drum) 7 is rotated, a surface of the photosensitive drum is uniformly charged by a charge means 8. Thereafter, the photosensitive drum 7 is exposed by the information light from the optical system 1 through an exposure portion 9 to form the latent image. Then, the latent image is visualized by a developing means 10 as the toner image. After the toner image has been transferred to the recording medium 2 by the transfer means 4, the residual toner remaining on the photosensitive drum 7 is removed by a cleaning means 11. Incidentally, various parts such as the photosensitive drum 7 and the like are housed in a frame 12 comprising a toner frame 12*a* and a cleaning frame 12*b* (which are made of resin) to form a cartridge.

Image Forming Apparatus

Next, the optical system, convey means, transfer means, fixing means, and cartridge mounting means of the image forming apparatus A will now be described in order.

Optical System

The optical system 1 serves to illuminate the information light on the photosensitive drum 7 in response to image information sent from an external device to the image forming apparatus. As shown in FIG. 1, the optical system comprises an optical unit 1*a* which is mounted within a body 13 of the image forming apparatus and which includes therein a laser diode 1*b*, a polygon mirror 1*c*, a scanner motor 1*d* and a focusing lens 1*e*.

When an image signal is sent from the external device such as a computer or a word processor to the image forming apparatus, the laser diode 1*b* emits light in response to the image signal, which light is incident to the polygon mirror 1*c* as image light. The polygon mirror 1*c* is rotated at a high speed by the scanner motor 1*d* so that the image light reflected by the polygon mirror 1*c* is incident to the rotating photosensitive drum 7 through the focusing lens 1*e* and a reflection mirror 1*f*, thereby selectively exposing the surface of the photosensitive drum 7 to form the latent image corresponding to the image information.

Recording Medium Convey Means

The convey means 3 for conveying the recording medium or recording material (for example, a recording paper sheet, an OHP sheet, a thin film or the like) 2 has a mounting portion formed on the apparatus body 13 and adapted to mount a cassette 3*a*. The recording materials 2 contained in the cassette 3*a* mounted on the mounting portion are separated one by one from an uppermost one by means of a pick-up roller 3*b*, and the separated recording material is sent to a pair of regist rollers $3c_1$, $3c_2$ which serve to convey the recording material 2 to an image transfer station in synchronous with the image formation. After, the toner image has been transferred to the recording material, the recording material 2 is sent to the fixing means 5 through a convey roller 3*d* and a guide plate 3*e*. After a fixing operation is finished, the recording material 2 is discharged onto the discharge portion 6 formed on the apparatus body 13 at an upper side thereof, by means of discharge rollers 3*f*.

Transfer Means

The transfer means 4 serves to transfer the toner image formed on the photosensitive drum 7 to the recording material 2. In the illustrated embodiment, as shown in FIG. 1, the transfer means 4 comprises a transfer roller 4. That is to say, the recording material 2 is urged against the photosensitive drum 7 of the process cartridge B by the transfer roller 4, and, by applying to the transfer roller 4 voltage having polarity opposite to charging polarity of the toner image formed on the photosensitive drum 7, the toner on the photosensitive drum 1 is transferred onto the recording material 2.

Fixing Means

The fixing means 5 serves to fix the toner image transferred to the recording material 2 (by the application of the voltage to the transfer roller 4) to the recording material 2. As shown in FIG. 1, the fixing means 5 comprises a rotatable drive roller 5*a*, and a fixing roller 5*b* having a heater therein and urged against the drive roller 5*a* to be driven by the rotation of the drive roller. That is to say, while the recording material 2 on which the toner image was transferred is being passed through between the drive roller 5*a* and the fixing roller 5*b*, the toner on the recording material 2 is fixed to the recording material 2 by pressure between the rollers 5*a*, 5*b* and heat from the fixing roller 5*b*.

Process Cartridge Mounting Means

The image forming apparatus A is provided with a cartridge mounting means capable of mounting the process cartridge B. The mounting/dismounting of the process cartridge B with respect to the body 13 of the image forming apparatus is effected by opening an opening/closing cover 14. That is to say, the opening/closing cover 14 is pivotally mounted on the apparatus body 13 via hinges 14a. When the opening/closing cover 14 is opened, as shown in FIG. 3, a cartridge mounting space formed in the apparatus body 13 is exposed. Further, left and right symmetrical guide members G1 are formed on left and right side walls defining the cartridge mounting space (in FIG. 3, only one guide member G1 is shown). Each guide member G1 has a guide for guiding the insertion of the process cartridge B so that, after the process cartridge B is inserted along the guides G2, by closing the opening/closing cover 14, the process cartridge B can be mounted within the image forming apparatus A.

Process Cartridge

Next, various elements of the process cartridge B to be mounted on the image forming apparatus A will be explained.

As mentioned above, the process cartridge B comprises the electrophotosensitive member, and at least one process means. The process means may be, for example, a charge means for charging the photosensitive member, a developing means for developing the latent image formed on the photosensitive member, a cleaning means for removing the residual toner remaining on the photosensitive drum or the like. In the illustrated embodiment, as shown in FIG. 2, the process cartridge B comprises the electrophotographic photosensitive drum 7 around which the charge means 8, exposure portion 9, developing means 10 and cleaning means 11 are arranged, and has a housing comprised of an upper frame 12*a* and a lower frame 12*b* and constituting a unit in which the above-mentioned elements 7–11 are housed and which can removably be mounted on the apparatus body 13. In the illustrated embodiment, the upper and lower frames 12*a*, 12*b* are formed by injection molding of synthetic resin such as acrylonitrile/butadien/styrene copolymer (ABS) resin, polystyrene (PS) resin or the like.

Next, the photosensitive drum 7, charge means 8, exposure portion 9, developing means 10 and cleaning means 11 of the process cartridge B will be fully described in order.

Photosensitive Drum

Figure 4:
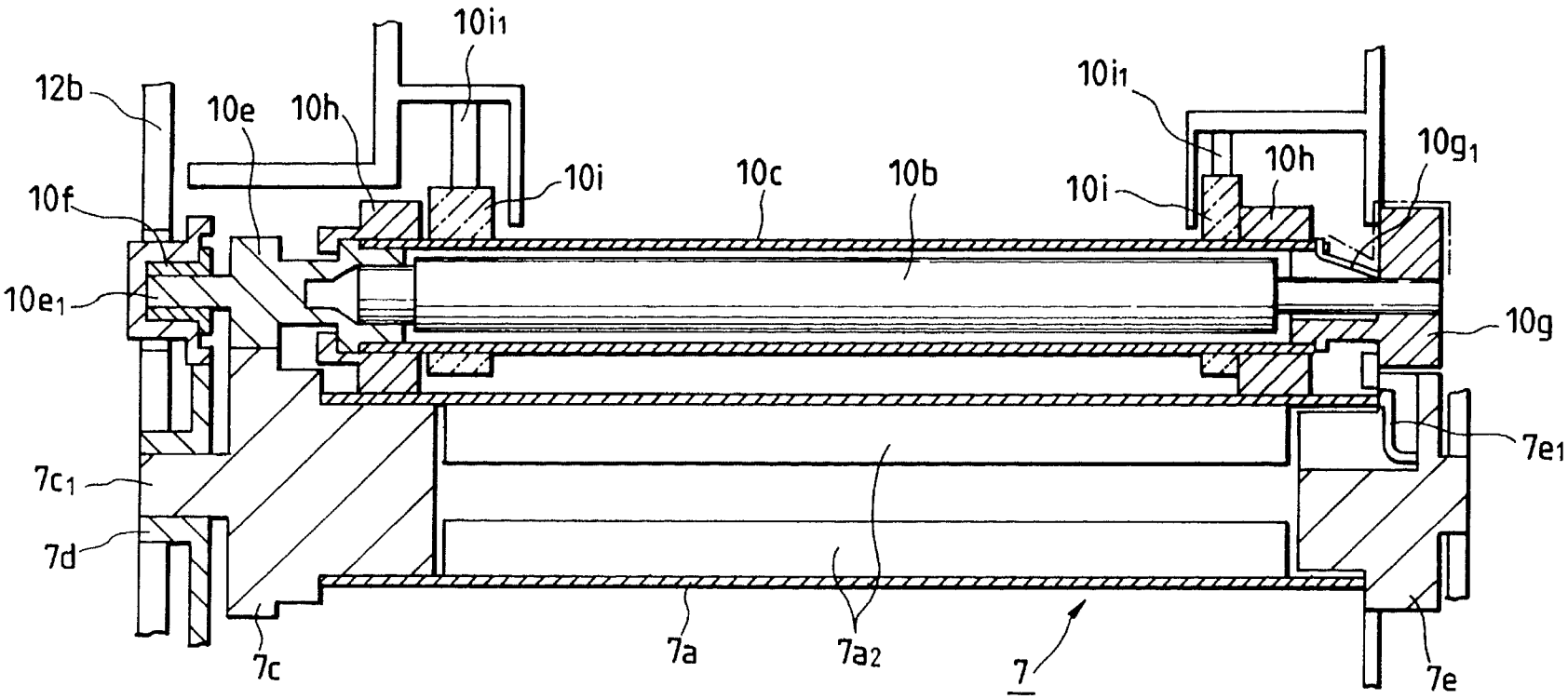
FIG. 4 is a longitudinal sectional view of a photosensitive drum and a developing sleeve.
Figure 5:
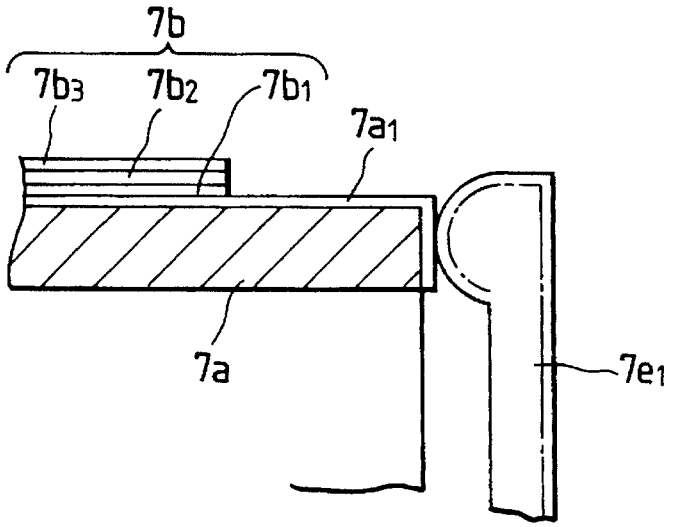
FIG. 5 is a partial sectional view of the photosensitive drum.

In the illustrated embodiment, as shown in FIGS. 4 and 5, the photosensitive drum 7 comprises a cylindrical drum base 7*a* and an organic photosensitive layer 7*b* coated on a peripheral surface of the drum base. The photosensitive drum 7 is rotatably mounted on the lower frame 12*b*. The photosensitive drum 7 is rotated in a direction shown by the arrow in FIG. 1 in response to the image forming operation, by transmitting a driving force of a drive motor of the image forming apparatus to the photosensitive drum via a flange gear (helical gear) 7*c* formed on one longitudinal end of the photosensitive drum 7.

The drum base 7*a* is made of high rigid synthetic resin (for example, polycarbonate (PC) including certain filler, polybutylene terephthalate (PBT), polybutylene ether (PPE) or the like), and, as shown in FIG. 5, a non-magnetic conductive material (for example, nickel, copper, or conductive paint including nickel or copper) layer $7a_1$ is formed on the peripheral surface of the base 7*a* by coating, depositing or electroplating, which layer extends along the entire peripheral surface up to the both ends of the drum base and also covers both end surfaces of the drum base. A UC layer $7b_1$, a CG layer $7b_2$ and a CT layer $7b_3$ are successively formed on the non-magnetic conductive layer $7a_1$. The layers $7b_1$–$7b_3$ constitute the organic photosensitive layer 7*b*. Incidentally, in the illustrated embodiment, as shown in FIG. 4, the drum base 7*a* is provided at its inner peripheral surface with radial ribs $7a_2$ extending in an axial direction of the drum base, thereby reinforcing the drum base 7*a*.

Further, the flange gear 7*c* secured to one longitudinal end of the drum base 7*a* is formed by molding synthetic resin (for example, polyacetal) and is provided at its one end with a drum shaft $7c_1$ which is rotatably mounted on the lower frame 12*b* via a bearing member 7*d*.

In addition, a drum bearing member 7*e* is fitted in the other longitudinal end of the drum base 7*a* to rotatably support the photosensitive drum 7. A contact spring portion $7e_1$ integrally formed with the bearing member 7*e* is contacted with the non-magnetic conductive layer $7a_1$ formed on the drum base 7*a* at the end surface of the drum base. The drum bearing member 7*e* having the contact spring portion $7e_1$ is made of high elastic synthetic resin (for example, polyacetal including certain filler, polyamide alloy, polybutylene sulfide, ABS resin, PS resin or the like), and a conductive layer is formed on the contact spring portion $7e_1$ at least at an area shown by the dot and chain line in FIG. 5 by coating, depositing or electroplating, thereby permitting the electrical connection between the drum base 7*a* and the contact spring portion. The drum bearing member 7*e* is secured to the lower frame 12*b* so that, during the image formation, the contact spring portion $7e_1$ is slidingly contacted with the drum base 7*a*, thereby carting the photosensitive drum through the contact spring portion $7e_1$ connected to the earth of the apparatus body 13.

As mentioned above, since the drum base 7*a* has the reinforcing ribs $7a_2$ to increase the rigidity of the drum base, the drum base may be made of the same material as that of the frames 12*a*, 12*b* (for example, ABS resin, PS resin or the like), and the flange gear 7*c* and the drum bearing member 7*e* may also be made of the same synthetic resin as the drum base. Incidentally, if the drum bearing member 7*e* is made of conductive plastic, the conductive layer on the contact spring portion $7e_1$ as mentioned above can be omitted.

Charge Means

Figure 6A:
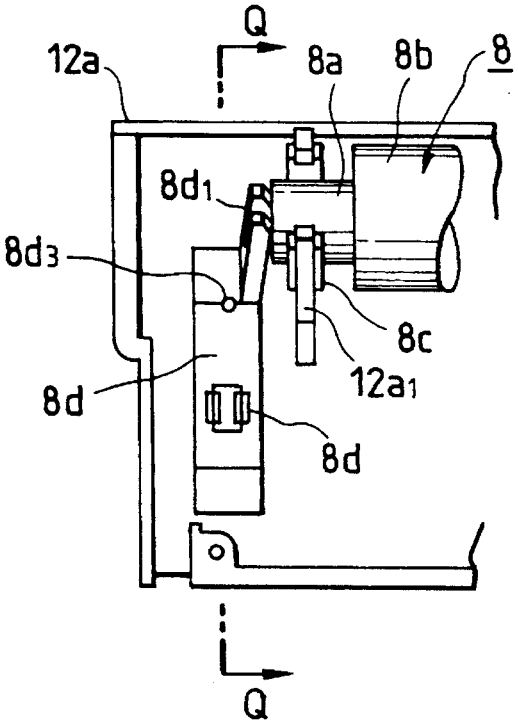
FIGS. 6A and 6B are views for explaining a bias contact of a charge roller.
Figure 6B:
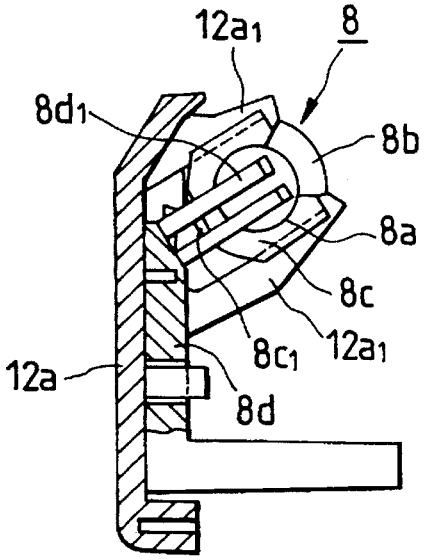

The charge means serves to uniformly charge the surface of the photosensitive drum 7. In the illustrated embodiment, as shown in FIGS. 2, 6A and 6B, the charge means is of a so-called contact charge type and comprises a charge roller 8 rotatably mounted on the frame. Incidentally, FIGS. 6A is an explanatory view for explaining an end portion of the charge roller and FIG. 6B is a sectional view taken along the line Q—Q in FIG. 6A.

As shown in FIGS. 6A and 6B, the charge roller 8 comprises a roller shaft 8*a* on which a conductive layer is formed by depositing or electroplating through the entire peripheral surface and end surfaces of the shaft, and a roller portion 8*b* mounted on the roller shaft and made of conductive plastic elastomer.

The roller shaft 8*a* is rotatably mounted, at its both ends, on bearing members 8*c* made of synthetic resin (for example, carbon-added polyacetal). Each bearing member 8*c* is slidably supported by a locking pawl $12a_1$ integrally formed with the upper frame 12*a*, but cannot be detached from the locking pawl. The bearing member 8*c* is biased by a spring portion $8c_1$ integrally formed with the bearing member to urge the roller portion 8*b* against the photosensitive drum 7.

Further, a spring contact portion $8d_1$ of a charge electrode 8*d* is contacted with the roller shaft 8*a*. As shown in FIG. 6A, the charge electrode 8*d* is removably attached to the upper frame 12*a* via an attachment pawl $8d_2$ and a positioning boss $8d_3$. The charge electrode 8*d* is made of conductive plastic, or is made of non-conductive plastic on which a conductive layer is formed by depositing or electroplating, so that, by contacting the spring contact portion $8d_1$ with the end surface of the roller shaft 8*a*, charge bias can be applied to the charge roller 8 via the charge electrode 8*d* connected to a power source of the image forming apparatus.

The roller portion 8*b* of the charge roller 8 is contacted with the photosensitive drum 7 so that the charge roller 8 is rotatingly driven by the rotation of the photosensitive drum 7 during the image formation. In this case, by applying the charge roller 8 to DC voltage and AC voltage in an overlapped fashion, the surface of the photosensitive drum 7 is uniformly charged.

Incidentally, the charge electrode 8*d* is not necessarily removable with respect to the upper frame 12*a*, but may be secured to the upper frame 12*a* by heat-welding. Further, the spring portion $8c_1$ is not necessarily formed integrally with the bearing member 8*c*, but a spring member made of synthetic resin may be attached to the bearing member 8*c*.

Exposure Portion

The exposure portion 9 serves to form the electrostatic latent image on the surface of the photosensitive drum 7 by illuminating the light image from the optical system 1 onto the surface of the photosensitive drum uniformly charge by the charge roller 8. The exposure portion has an opening 9 formed an upper surface of the cartridge frame and adapted to direct the light image to the drum.

Developing Means

As shown in FIG. 2, the developing means 10 has a toner reservoir containing the toner therein, and a toner feed member 10*a* for feeding the toner rotatably arranged within the toner reservoir. Further, a developing sleeve 10*c* having a non-rotating magnet 10*b* therein is arranged at an outlet of the toner reservoir with a small gap between the photosensitive drum 7 and the developing sleeve. When the developing sleeve is rotated, a thin toner layer is formed on the developing sleeve.

Figure 7:
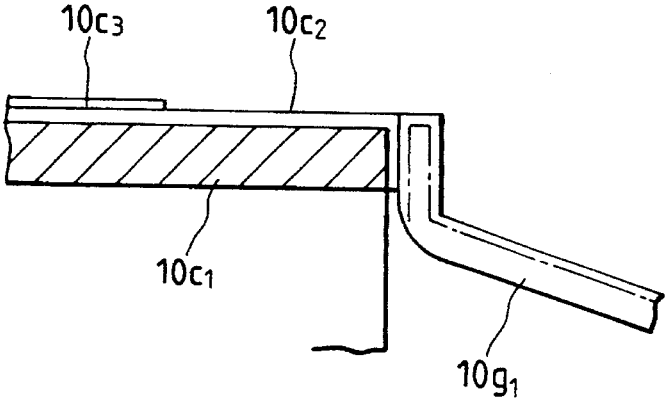
FIG. 7 is a view for explaining a bias contact of 10 a developing sleeve.

The developing sleeve 10*c* comprises a cylindrical sleeve base $\mathbf{10}c_1$ made of high rigid synthetic resin similar to that of the drum base 7*a* (for example, polycarbonate (PC), polybutylene terephthalate (PBT), polybutylene ether (PPE) or the like), and, as shown in FIG. 7, a non-magnetic conductive material (for example, nickel, copper, or conductive paint including nickel or copper) layer $\mathbf{10}c_2$ formed on the peripheral surface of the sleeve base by coating, depositing or electroplating, which layer extends along the entire peripheral surface up to the both ends of the drum base and also covers both end surfaces of the drum base. Further, a coating layer $\mathbf{10}c_3$ made of carbon group material is formed on the conductive layer $\mathbf{10}c_2$ through a predetermined range.

As shown in FIG. 4, a sleeve gear 10*e* made of synthetic resin (for example, polyacetal) is secured to one end of the developing sleeve 10*c*. A gear shaft $\mathbf{10}e_1$ integrally formed with the sleeve gear 10*e* is rotatably supported by the lower frame 12*b* via a bearing member 10*f* so that the gear shaft is slidable with respect to the lower frame in an axial direction.

On the other hand, as shown in FIG. 4, the other end of the developing sleeve 10*c* is loosely fitted onto a sleeve bearing member 10*g* secured to the lower frame 12*b* and made of synthetic resin (for example, polyacetal including certain filler, polyamide alloy, polybutylene sulfide, ABS resin, PS resin or the like) so that the sleeve base $\mathbf{10}c_1$ can slidably rotated around the sleeve bearing member. A spring contact portion $\mathbf{10}g_1$ is integrally formed with the sleeve bearing member 10*g* so that, as shown in FIG. 7, the spring contact portion $\mathbf{10}g_1$ is contacted with the non-magnetic conductive layer $\mathbf{10}c_2$ on the end surface of the sleeve base $\mathbf{20}c_1$.

A conductive layer is formed on a surface of the spring contact portion $\mathbf{10}g_1$ by coating, depositing or electroplating at a predetermined zone (including the contact portion contacting with the conductive layer $\mathbf{10}c_2$) shown by the dot and chain line in FIG. 7 so that the developing bias can be applied to the developing sleeve 10*c* from the power source of the image forming apparatus via the spring contact portion $\mathbf{10}g_1$.

Further, as shown in FIG. 4, ring members 10*h* each made of synthetic resin (for example, polyacetal) and having an outer diameter slightly greater than an outer diameter of the sleeve base $\mathbf{10}c_1$ are arranged at the proximity of both ends of the developing sleeve 10*c*, and the developing sleeve 10*c* is biased toward the photosensitive drum 7 by spring portions $\mathbf{10}i_1$ integrally formed with bearings 10*i* made of synthetic resin (for example, polyacetal including certain filler, polyamide alloy, polybutylene sulfide, ABS resin, PS resin or the like) and fitted on the developing sleeve near its both ends. With this arrangement, the ring members 10*h* are abutted against the photosensitive drum 7. When the rotational force is transmitted to the sleeve gear 10*e*, the developing sleeve 10*c* is rotated with the small gap between the developing sleeve and the photosensitive drum 7.

Incidentally, if the sleeve bearing member 10*g* is made of conductive plastic, the conductive layer on the spring contact portion $\mathbf{10}g_1$ can be omitted. Further, the spring portions $\mathbf{10}i_1$ are not necessarily formed integrally with the respective bearings 10*i*, but such spring portions may be made of synthetic resin and may be attached to the respective bearings 10*i*.

Next, a developing blade 10*d* will be explained. The developing blade serves to regulate a thickness of the toner layer formed on the surface of the developing sleeve 10*c* and is attached to a blade support member 10*j* which is secured to the lower frame 12*b* by screws or heat-welding. The blade support member 10*j* is made of high rigid synthetic resin similar to that of the drum base 7*a* of the photosensitive drum, and the developing blade 10*d* is integrally formed with the support member 10*j* by outsert molding or two color molding.

The developing blade 10*d* is elastically urged against a peripheral surface of the developing sleeve 10*c* by an elastic force of the plastic elastomer by which the blade is formed, thereby regulating the thickness of the toner layer on the developing sleeve. When the toner layer is formed, the frictionally charged charge sufficient to develop the electrostatic latent image on the photosensitive drum 7 is obtained due to the friction between the toner and the developing sleeve 10*c*.

Further, as shown in FIG. 2, below the developing sleeve 10*c*, there is arranged a sheet member 10*k* abutted against the developing sleeve 10*c* along a longitudinal direction of the sleeve to prevent the toner from leaking from the toner reservoir. The sheet member 10*k* is made of plastic elastomer and is attached to an end face of the lower frame 12*b* by outsert molding, two color molding or welding.

Although the developing blade 10*d* and the blade support member 10*j* have different rigidity for their purposes, it is preferable that the developing blade 10*d* is made of material similar to that of the blade support member 10*j* (for example, ABS or PS plastic elastomer) and these elements and the sheet member 10*k* are made of material same as or similar to that of the frames 12*a*, 12*b*. With this arrangement, when the process cartridge B is recycled, the developing blade 10*d* and/or blade support member 10*j* can be melted together with the frame 12*b* to obtain "pellet" which can be reused as material.

Cleaning Means

As shown in FIG. 2, the cleaning means 11 comprises a cleaning blade 11*a* contacted with the surface of the photosensitive drum 7 to scrape the residual toner remaining on the photosensitive drum 7, a dip sheet 11*b* arranged below the blade 11*a* and contacted with the surface of the photosensitive drum 7 to receive the scraped toner, and a waste toner reservoir 11*c* for collecting the waste toner gathered by the dip sheet.

Similar to the developing blade 10*d*, the cleaning blade 11*a* is attached to a blade support member 11*d*, and the blade support member 11*d* is attached to the lower frame 12*b* by screws or welding. The support member 11*d* is made of high rigid synthetic resin the same as that of the drum base 7*a* of the photosensitive drum (for example, polycarbonate, polybutylene terephthalate, polybutylene ether or the like), and the cleaning blade 11*a* made of plastic elastomer is integrally formed on the support member 11*d* by outsert molding or two color molding.

Further, as shown in FIG. 2, the dip sheet 11*b* is made of plastic elastomer and is attached to the end face of the lower frame 12*b* by outsert molding, two color molding or welding so that a tip end of the dip sheet is lightly contacted with the photosensitive drum 7 along the longitudinal direction of the drum.

Similar to the developing blade 10*d*, it is preferable that the cleaning blade 11*a* is made of material similar to that of the blade support member 11*d* (for example, ABS or PS plastic elastomer) and these elements and the dip sheet 11*b* are made of material same as or similar to that of the frames 12*a*, 12*b*. With this arrangement, when the process cartridge B is recycled, the cleaning blade 11*a* and/or blade support member 11*d* can be melted together with the frame 12*b* to obtain "pellet" which can be reused as material.

Toner Leak Preventing Seal

In the process cartridge B according to the illustrated embodiment, in order to prevent the toner from leaking through the interface between the upper and lower frames 12*a*, 12*b*, as shown in FIG. 2, toner leak preventing seals 16 are provided. The seals 16 are made of plastic elastomer and are integrally formed in recesses of the upper frame by pouring or two color molding. Similar to the above-mentioned elements, the seals 16 are formed from the same material as the frame. Further, in order to prevent the toner from leaking through clearances between both longitudinal ends of the developing sleeve 10*c* and the developing blade 10*d* and the lower frame 12*b*, and clearances between both longitudinal ends of the cleaning blade 11*a* and the photosensitive drum 7 and the lower frame 12*b*, there are provided seal members 15 made of soft plastic.

As mentioned above, since the main parts or elements constituting the process cartridge B are made of synthetic resin, when the cartridge is recycled, it is possible to recycle the cartridge by treating the synthetic resin, thereby facilitating the reuse of material. Thus, the recycling efficiency can be improved and the decrease in cost can be achieved.

Incidentally, the above-mentioned main elements include the photosensitive drum 7, developing sleeve 10*c*, developing blade 10*d*, blade support member 10*j*, electrode contacts, cleaning blade 11*a*, blade support member 11*d* and the like, and, it is preferable that all of these elements are made of synthetic resin. However, even when some of these elements are made of synthetic resin, the recycling efficiency can, of course, be improved.

Second Embodiment

Next, a second embodiment of the present invention wherein toner leak preventing seals are integrally formed with blade members will be explained with reference to FIGS. 8 and 9. Incidentally, elements having the same function as those of the first embodiment are designated by the same reference numerals.

A process cartridge B according to this embodiment has substantially similar construction to that of the first embodiment, and the seal members 15 and the developing blade 10*d* or the cleaning blade 11*a* of the first embodiment are integrally formed with each other. Now, an example that the developing blade 10*d* and the seal members 15 are integrally formed with each other will be fully described.

Figure 8:
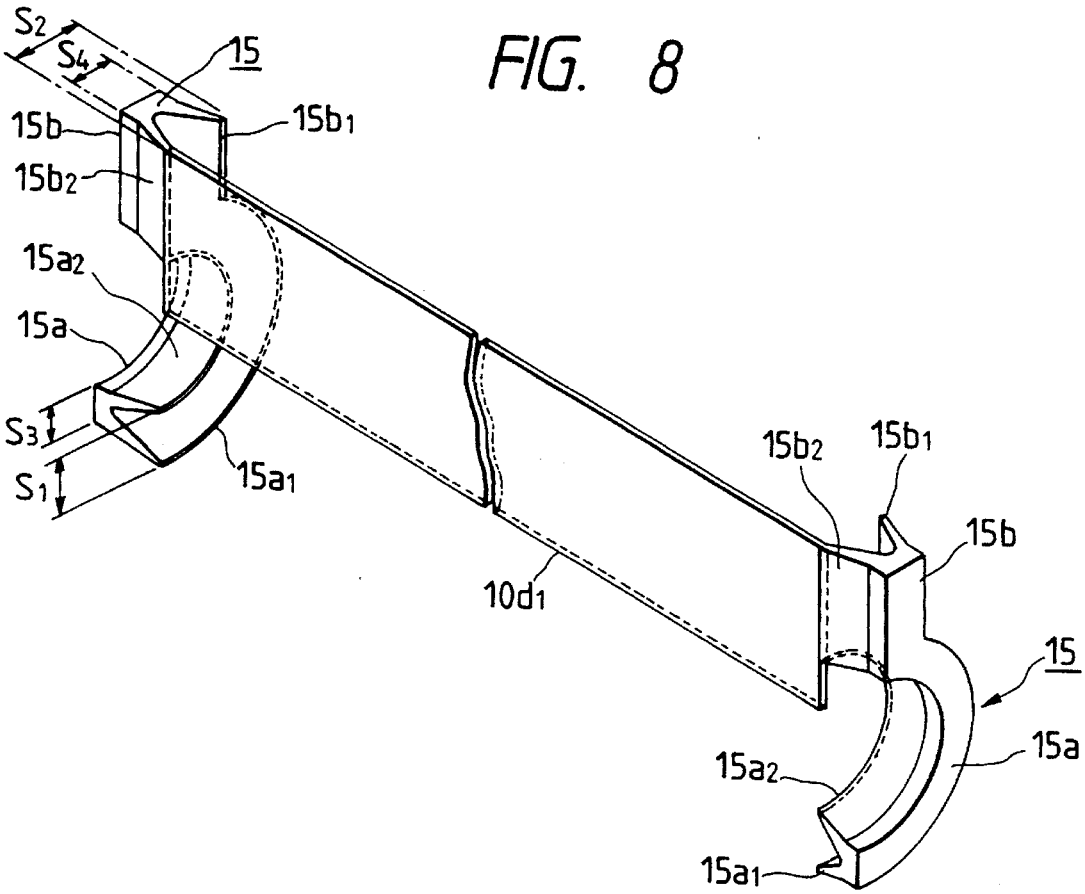
FIG. 8 is a perspective view showing an embodiment wherein seal members are integrally formed on both ends of a developing blade.
Figure 9:
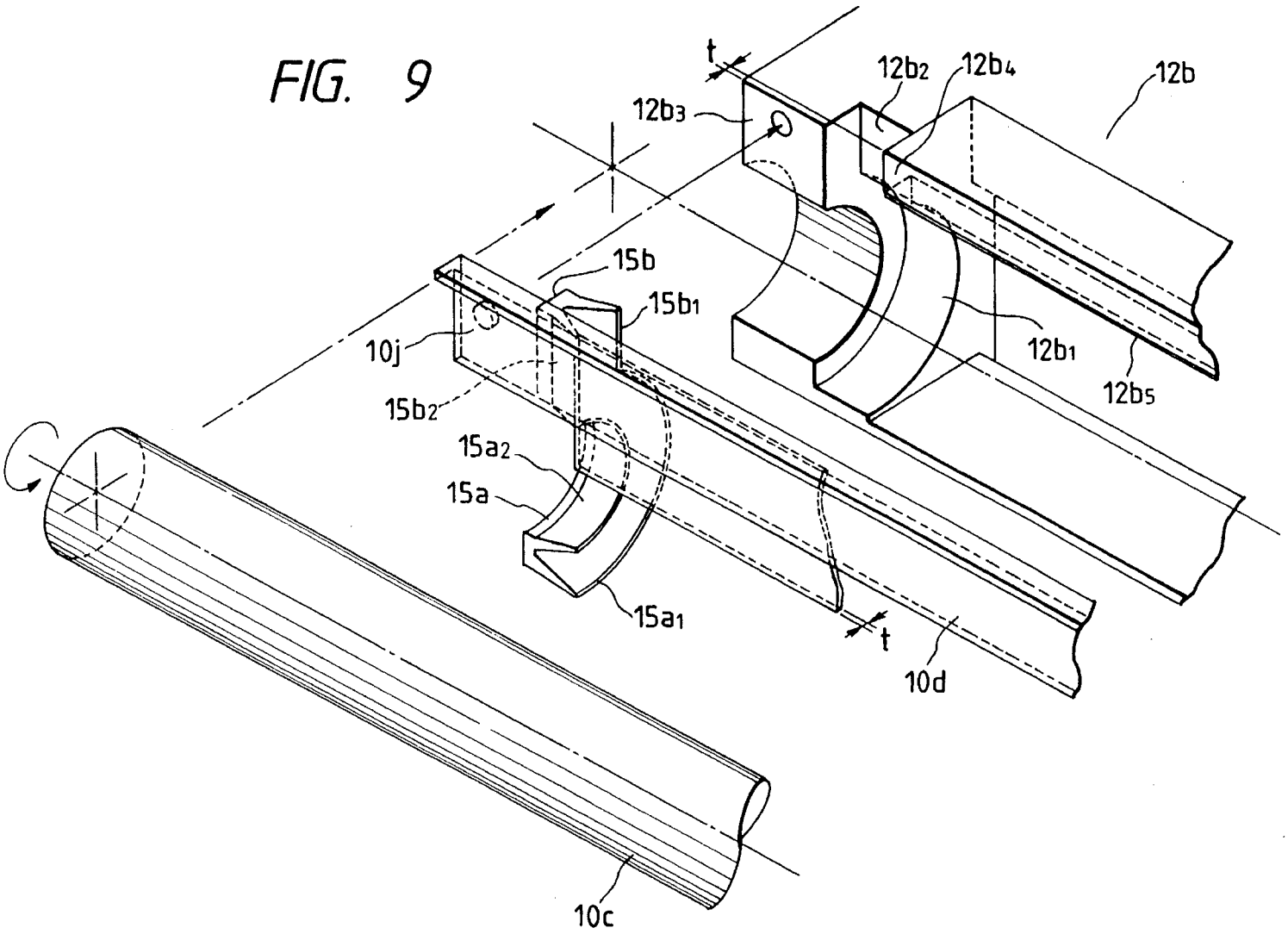
FIG. 9 is an exploded perspective view for explaining the attachment of the developing blade of FIG. 8 to a frame.

The developing blade 10*d* according to this embodiment is made of soft plastic, and, as shown in FIG. 8, the seal members 15 are integrally formed on both longitudinal ends of the developing blade. Each seal member 15 has a rotary member sealing portion 15*a* for sealing a clearance between the developing sleeve 10*c* and the lower frame 12*b* to which the sleeve 10*c* is attached, a blade sealing portion 15*b* for sealing a clearance between the blade support member 10*j* for attaching the developing blade 10*d* to the lower frame 12*b* and the lower frame 12*b* to which the blade support member 10*j* is attached.

Further, the rotary member sealing portion 15*a* has an outer lip portion $15a_1$ for effecting the seal with respect to the frame 12*b* and an inner lip portion $15a_2$for effecting the seal with respect to the developing sleeve 10*c*, and the blade sealing portion 15*b* has an outer lip portion $15b_1$ for effecting the seal with respect to the frame 12*b* and an inner lip portion $15b_2$ for effecting the seal with respect to the blade support member 10*j* and has a laid U-shaped cross-section. The inner lip portion $15b_2$ of the blade sealing portion 15*b* is integrally connected to the developing blade 10*d*, and the developing blade 10*d* has a free end edge portion $10d_1$ extending below the inner lip portion $15b_2$ to be elastically contacted with the developing sleeve 10*c*.

Next, a seal seat surface of the frame 12*b* with respect to the seal member 15 will be explained with reference to FIG. 9.

A semi-circular seat surface $12b_1$ of the rotary member sealing portion 15*a* for sealing the clearance between the developing sleeve 10*c* and the frame 12*b* has an outer diameter slightly greater than that of the developing sleeve 10*c*. Further, a flat seat surface $12b_2$ of the blade sealing portion 15*b* for sealing the clearance between the blade support member 11*d* and the frame 12*b* is retarded from an attachment seat surface $12b_3$ of the blade support member 10*j* to be spaced away from the developing blade 10*d* and is contiguous to the semi-circular seat surface $12b_1$. Further, a portion of the frame 12*b* against which the developing blade 10*d* is abutted has a flat blade seat surface $12b_4$ retarded from the attachment seat surface $12b_3$ by a distance corresponding to a thickness t of the developing blade 10*d*, and an edge portion $12b_5$ for abutting against the blade support member 10*j* is protruded from the blade seat surface $12b_4$.

As shown in FIG. 8, a clearance formed between the semi-circular seat surface $12b_1$ and the developing sleeve 10*c* and a clearance formed between the flat seat surface $12b_2$ and the blade support member 10*j* are smaller than widths $s_1$, $s_2$ of tip ends of the lip portions of the rotary member sealing portion 15*a* and the blade sealing portion 15*b* of the seal member 15 and are greater than widths $s_3$, $s_4$ of the base of the seal member 15.

When the developing blade 10*d* having the seal member 15 at its both ends is attached to the frame 12*b* having the above-mentioned seat surfaces, the toner can be prevented from leaking through the clearance formed between the developing sleeve 10*c* and the frame 12*b* and through the clearance formed between the blade support member 10*j* and the frame 12*b*, since the lip portions $15a_1$, $15a_2$, $15b_1$, $15b_2$ of the rotary member sealing portion 15*a* and the blade sealing portion 15*b* of the seal member 15 are elastically and closely contacted with the developing sleeve 10*c*, blade support member 10*j* and lower frame 12*b*.

Further, since the edge portion $12b_5$ protruded from the blade seat surface $12b_4$ is penetrated into the space between the developing blade 10*d* and the flame 12*b*, the toner can be prevented from leaking through such space.

As mentioned above, by integrally forming the seal members 15 on both longitudinal ends of the developing blade 10*d*, it is possible to eliminate a danger of creating any gap(s) between the longitudinal ends of the developing sleeve 10*d* and the frame 12*d* due to the lack of dimensional accuracy and/or assembling accuracy if the seal members 15 are formed independently from the developing blade 10*d*, and it is also possible to eliminate the need of sealing such gap with additional seal. Further, by integrally forming the seal members 15 with the developing blade 10*d*, the number of parts can be reduced and the a decrease cost can be achieved. In addition, since there is no need for applying seal members as in the conventional case, the number of steps of assembling operation can be reduced, thereby facilitating the assembling operation and permitting an automatic assembling operation. Further, since a curvature of the rotary member sealing portion 15*a* of the seal member 15 can easily be reduced, even when a smaller developing sleeve 10*c* is used, it is possible to surely prevent the toner leakage. Accordingly, the process cartridge B can easily be made compact.

Incidentally, in the above-mentioned toner preventing structure, while an example that the seal members 15 are integrally formed on both longitudinal ends of the developing blade 10*d* was explained, it should be understood that such seal members 15 may be integrally formed on both longitudinal ends of the cleaning blade 11*a*.

Third Embodiment

Next, as a third embodiment of the present invention, an alteration of the second embodiment will be explained with reference to FIGS. 10 and 11. Incidentally, elements having the same function as those of the first and second embodiments are designated by the same reference numerals.

Figure 10:
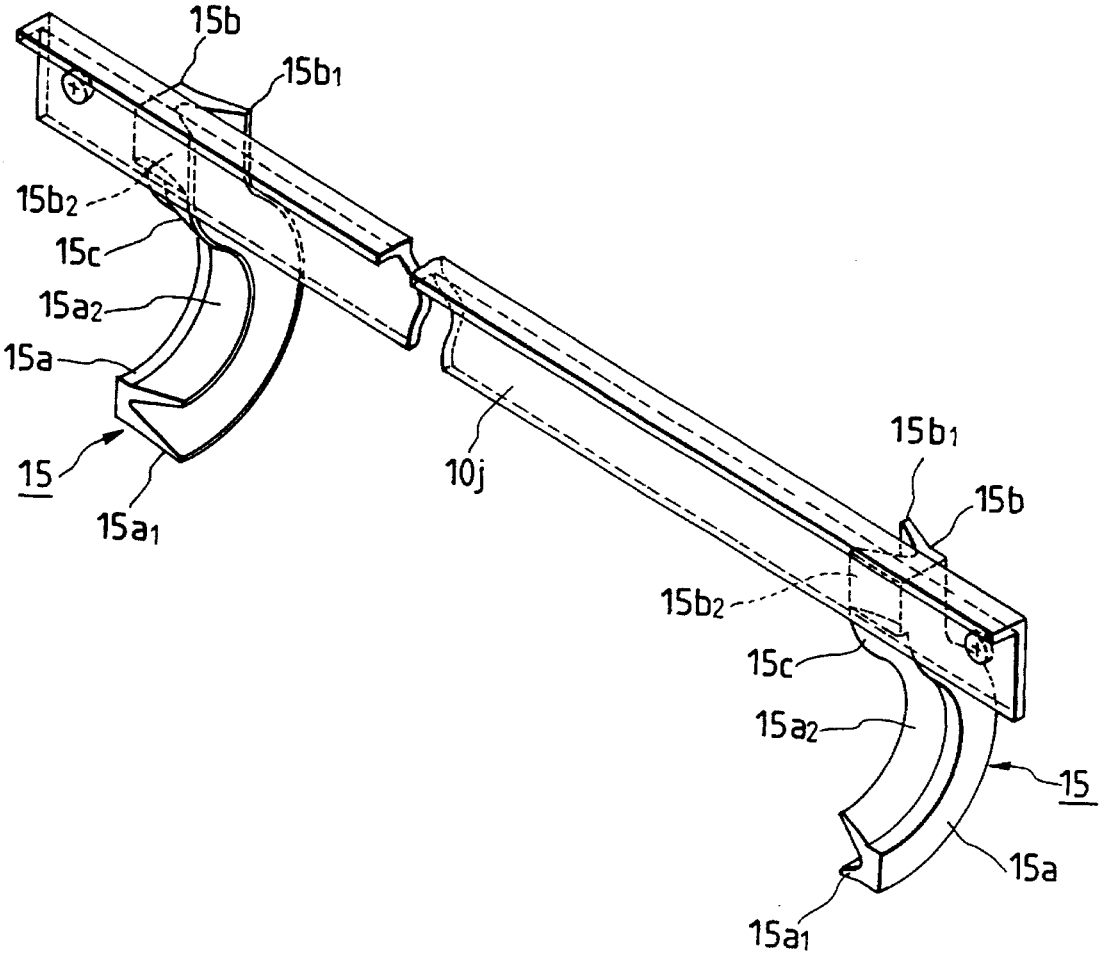
FIG. 10 is a perspective view showing an embodiment wherein seal members are integrally formed with a blade support member.
Figure 11:
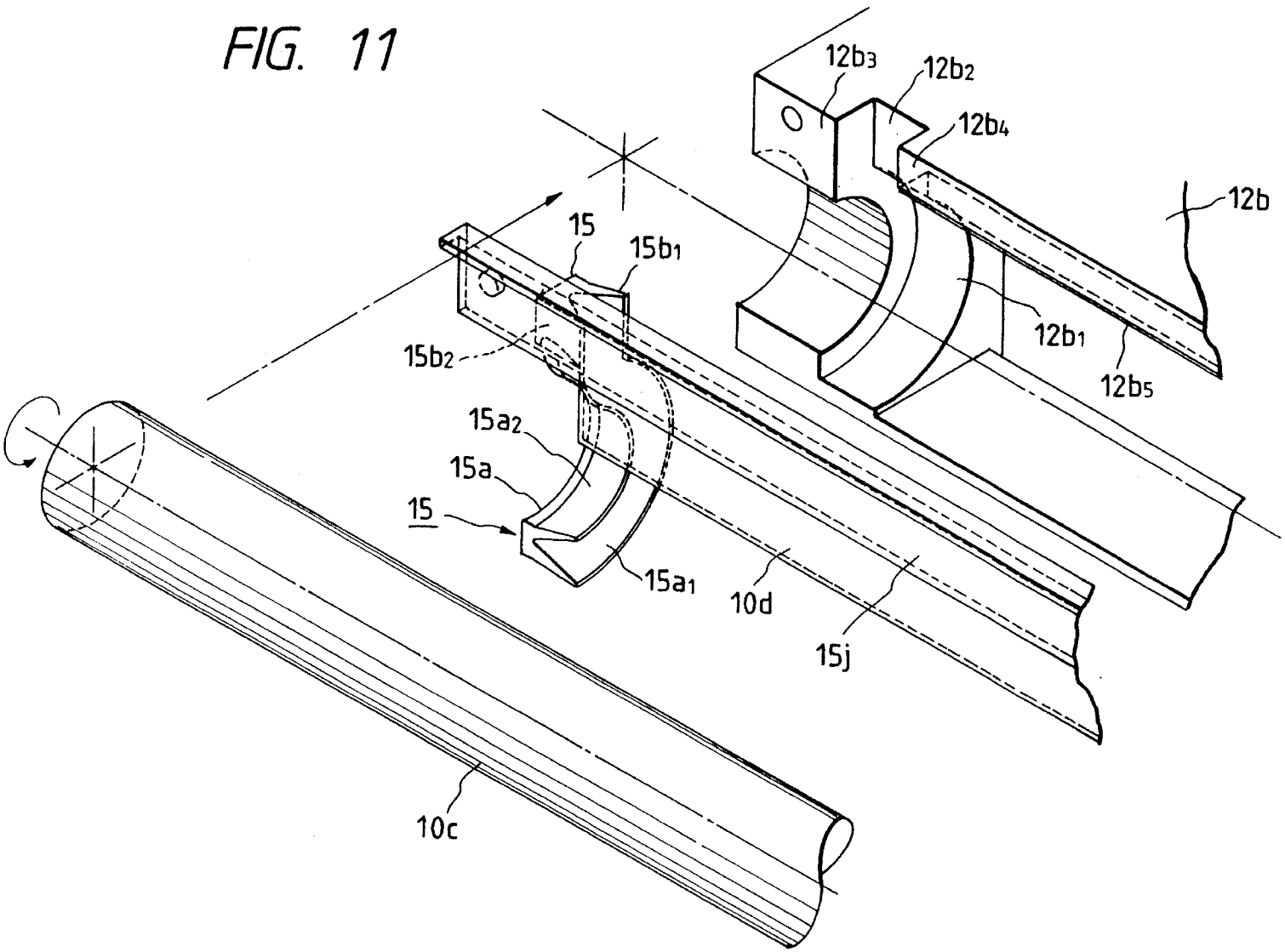
FIG. 11 is an exploded perspective view for explaining the attachment of the blade support member of FIG. 10 to a frame.

In the second embodiment, while the seal members 15 were integrally formed on both longitudinal ends of the developing blade 10*d*, as shown in FIG. 10, the seal members 15 may be integrally formed with the blade support member 10*j* in the proximity of both longitudinal ends thereof.

In FIG. 10, when the developing blade 10*d* is attached to the blade support member 10*j*, the seal members 15 are arranged so that the longitudinal ends of the developing blade 10*d* are abutted against the seal members. The blade support member 10*j* is made of high rigid plastic and the seal members 15 are made of soft plastic, and the seal members 15 are integrally formed on the blade support member 10*j* by two color molding. Incidentally, when the blade support member 10*j* is formed from metal sheet, the seal members 15 are integrally assembled with the blade support member by adhesive, welding or outsert molding.

The seal member 15 according to this embodiment differs from that of the second embodiment in the point that a connection lip portion 15*c* at a connecting portion between the rotary member sealing portion 15*a* and the blade sealing portion 15*b* is so shaped as to conform to elastic deformation of the developing blade 10*d* when the blade is elastically contacted with the developing sleeve 10*c*.

The developing blade 10*d* is attached to the blade support member 10*j* having the seal members 15 as shown in FIG. 10 in such a manner that both longitudinal ends of the developing blade are abutted against the lip portions $\mathbf{15}a_2$, $\mathbf{15}b_2$ of the seal members. Then, as shown in FIG. 11, when the assembly is attached to the frame 12*b* having the seat surfaces same as those of the second embodiment, the lip portions $\mathbf{15}a_1$, $\mathbf{15}a_2$ of the rotary member sealing portions 15*a* are elastically penetrated into the gap formed between the developing sleeve 10*c* and the frame 12*b* to seal the gap. Further, the lip portions $\mathbf{15}b_1$, $\mathbf{15}b_2$ of the blade sealing portions 15*b* are elastically penetrated into the gap formed between the blade support member 10*j* and the frame 12*b* to seal such a gap. In this way, the toner leakage is prevented.

Further, since the both longitudinal ends of the developing blade 10*d* are abutted against the seal members 15 and the connection lip portion 15*c* is so shaped as to conform to the elastic deformation of the developing blade 10*d* when the blade is elastically contacted with developing sleeve 10*c*, there arises no gap at the connection lip portion, thereby preventing the toner from leaking at both longitudinal ends of the developing blade 10*d*.

Also in the third embodiment, the same technical advantage as that of the second embodiment can be achieved. Further, it should be noted that the third embodiment can also be applied to the cleaning blade 11*a* and blade support member 11*d*.

Other Embodiments

The process cartridge B according to the present invention mentioned above can preferably be applied to not only the cartridge for forming a mono-color image but also a cartridge having a plurality of developing means to form a colored image (for example, two-color image, three-color image or multi-color image).

Further, regarding the developing method, a conventional two-component magnet brush developing method, cascade developing method, touch-down developing method, cloud developing method or other appropriate developing method can be used.

Further, regarding the charge means, while the charge means of so-called contact charge type was used in the first embodiment, the charge means may be constituted by a conventional structure wherein there are three side walls formed from tungsten wires and these walls are shielded by metal shield, for example, made of aluminum so that positive or negative ions generated by applying high voltage to the tungsten wires are transferred onto the surface of the photosensitive drum, thereby uniformly charging the surface of the photosensitive drum. Incidentally, the charge means may be of blade (charge blade) type, pad type, block type, rod type, wire type or the like, as well as of the above-mentioned roller type.

In addition, a process cartridge includes an electrophotographic phtosensitive member as an image bearing member, and at least one process means. Accordingly, other than the above-mentioned process cartridge, the process cartridge incorporates therein an image bearing member and a charge means as a unit which can be removably be mounted to an image forming apparatus or incorporates therein an image bearing member and a developing means as a unit which can be removably be mounted to an image forming apparatus, or incorporates therein an image bearing member and a cleaning means as a unit which can be removably be mounted to an image forming apparatus, or incorporates therein an image bearing member and two or more process means as a unit which can be removably be mounted to an image forming apparatus.

That is to say, the process cartridge means that it incorporates therein an electrophotographic photosensitive member, and a charge means, a developing means or a cleaning means as a unit which can be removably be mounted to an image forming apparatus, or it incorporates therein an electrophotographic photosensitive member, and at least one of a charge means, a developing means and a cleaning means as a unit which can be removably be mounted to an image forming apparatus, or it incorporates therein an electrophotographic phtosensitive member, and at least a developing means as a unit which can be removably be mounted to an image forming apparatus.

Further, in the illustrated embodiments, while an example that the photosensitive drum, developing sleeve and the like are integrally assembled as a process cartridge which can be removably be mounted to the image forming apparatus to form the image was explained, the present invention can similarly be applied to an image forming apparatuses wherein such photosensitive drum, developing sleeve and the like may be directly arranged in the apparatus.

Furthermore, in the above-mentioned embodiments, while an example that the laser beam printer is used as the image forming apparatus was explained, the present invention is not limited to such an example, but may be applied to an electrophotographic copying machine, facsimile system, word processor and the like.

As mentioned above, by forming main image forming parts with synthetic resin, for example, when the process cartridge is recycled, the recycling operation can be effected only by treating the synthetic resin, thereby facilitating the reuse of the material. Thus, the recycling efficiency can be improved, and the a decrease cost can be achieved.

As mentioned above, according to the present invention, it is possible to provide a process cartridge and an image forming apparatus wherein recycling can easily be realized.

What is claimed is:

1. A process cartridge removably mountable to an image forming apparatus, said process cartridge comprising:

an electrophotographic photosensitive member including a drum base made of synthetic resin around which an electrophotographic photosensitive layer is coated; and process means acting on said electrophotographic photosensitive member, said process means including (a) a charge roller having a shaft made of synthetic resin and a roller portion made of conductive plastic elastomer, for charging said electrophotographic photosensitive member, (b) a developing sleeve made of synthetic resin and developing a latent image formed on said electrophotographic photosensitive member, and (c) a developing blade for regulating an amount of toner adhered to said developing sleeve, said developing blade being made of plastic elastomer attached to a support member made of synthetic resin.

2. A process cartridge according to claim 1, wherein said synthetic resin is polycarbonate (PC), polybutylene terephthalate (PBT) or polybutylene ether (PPE).

3. A process cartridge according to claim 1, wherein a molded gear made of synthetic resin is provided on one end of said drum base.

4. A process cartridge according to claim 3, wherein said synthetic resin is polyacetal.

5. A process cartridge according to claim 1, wherein a drum bearing made of synthetic resin for rotatably supporting said photosensitive member is provided on one end of said drum base.

6. A process cartridge according to claim 1, wherein said synthetic resin is polycarbonate (PC), polybutylene terephthalate (PBT) or polyphenylene ether (PPE).

7. A process cartridge according to claim 6, wherein a sleeve gear made of synthetic resin is provided on one end of said developing sleeve.

8. A process cartridge according to claim 1, where said process cartridge incorporates therein said electrophotographic photosensitive member, and charge means, developing means or cleaning means as process means as a unit which can removably be mounted to the image forming apparatus.

9. A process cartridge according to claim 1, wherein said process cartridge incorporates therein said electrophotographic photosensitive member, and at least one of charge means, developing means and cleaning means as process means as an unit which can removably be mounted to the image forming apparatus.

10. A process cartridge according to claim 1, wherein the process cartridge incorporates therein said electrophotographic photosensitive member, and at least developing means as process means as an unit which can removably be mounted to said image forming apparatus.

11. A process cartridge removably mountable to an image forming apparatus, said process cartridge comprising:

an electrophotographic photosensitive member including a drum base made of synthetic resin around which an electrophotographic photosensitive layer is coated and a drum bearing made of synthetic resin for rotatable supporting said electrophotographic photosensitive member and provided on one end of said drum base, wherein said drum bearing is integrally formed with a contact spring for earthing said drum base; and process means acting on said electrophotographic photosensitive member.

12. A process cartridge according to claim 11, wherein said synthetic resin is polycarbonate (PC), polybutylene terephthalate (PBT) or polybutylene ether (PPE).

13. A process cartridge according to claim 11, wherein a molded gear made of synthetic resin is provided on one end of said drum base.

14. A process cartridge according to claim 13, wherein said synthetic resin is polyacetal.

15. A process cartridge according to claim 11, wherein one of said main parts is a charge roller for charging said electrophotographic photosensitive member, and said charge roller has a shaft made of synthetic resin and a roller portion made of conductive plastic elastomer.

16. A process cartridge according to claim 11, wherein one of said main parts is a developing sleeve used to develop a latent image formed on said electrophotographic photosensitive member, and said developing sleeve is made of synthetic resin.

17. A process cartridge according to claim 16, wherein a developing blade for regulating amount of toner adhered to said developing sleeve is made of plastic elastomer attached to a support member made of synthetic rosin.

18. A process cartridge according to claim 11, wherein said synthetic resin is polycarbonate (PC), polybutylene terephthalate (PBT) or polybutylene ether (PPE).

19. A process cartridge according to claim 18, wherein a sleeve gear made of synthetic resin is provided on one end of said developing sleeve.

20. A process cartridge according to claim 11, wherein one of said main parts is a cleaning blade for removing toner remaining on said electrophotographic photosensitive member, and said cleaning blade is made of plastic elastomer and is attached to a support member made of synthetic resin.

21. A process cartridge according to claim 11, where said process cartridge incorporates therein said electrophotographic photosensitive member, and charge means, developing means or cleaning means as process means as a unit which can removably be mounted to the image forming apparatus.

22. A process cartridge according to claim 11, wherein said process cartridge incorporates therein said electrophotographic photosensitive member, and at least one of charge means, developing means and cleaning means as process means as an unit which can removably be mounted to the image forming apparatus.

23. A process cartridge according to claim 11, wherein the process cartridge incorporates therein said electrophotographic photosensitive member, and at least developing means as process means as an unit which can removably be mounted to said image forming apparatus.

24. A process cartridge removably mountable to an image forming apparatus, said process cartridge comprising:

an electrophotographic photosensitive member; and process means acting on said electrophotographic photosensitive member, said process means including a charge roller for charging said electrophotographic photosensitive member, said charge roller having a shaft made of synthetic resin and a roller portion made of conductive plastic elastomer.

25. A process cartridge according to claim 24, wherein one of said main parts comprises a drum base around which an electrophotographic photosensitive layer is coated, and said drum base is made of synthetic resin.

26. A process cartridge according to claim 25, wherein a molded gear made of synthetic resin is provided on one end of said drum base.

27. A process cartridge according to claim 26, wherein said synthetic resin is polyacetal.

28. A process cartridge according to claim 25, wherein a drum bearing made of synthetic resin for rotatably supporting said photosensitive member is provided on one end of said drum base.

29. A process cartridge according to claim 28, wherein said drum bearing member is integrally formed with a contact spring for earthing said drum base.

30. A process cartridge according to claim 24, wherein said synthetic resin is polycarbonate (PC), polybutylene terephthalate (PBT) or polybutylene ether (PPE).

31. A process cartridge according to claim 24, wherein one of said main parts is a developing sleeve used to develop a latent image formed on said electrophotographic photosensitive member, and said developing sleeve is made of synthetic resin.

32. A process cartridge according to claim 31, wherein said synthetic resin is polycarbonate (PC), polybutylene terephthalate (PBT) or polybutylene ether (PPE).

33. A process cartridge according to claim 32, wherein a sleeve gear made of synthetic resin is provided on one end of said developing sleeve.

34. A process cartridge according to claim 31, wherein a developing blade for regulating amount of toner adhered to said developing sleeve is made of plastic elastomer attached to a support member made of synthetic resin.

35. A process cartridge according to claim 24, wherein one of said main parts is a cleaning blade for removing toner remaining on said electrophotographic photosensitive member, and said cleaning blade is made of plastic elastomer and is attached to a support member made of synthetic resin.

36. A process cartridge according to claim 24, where said process cartridge incorporates therein said electrophotographic photosensitive member, and charge means, developing means or cleaning means as process means as a unit which can removably be mounted to the image forming apparatus.

37. A process cartridge according to claim 24, wherein said process cartridge incorporates therein said electrophotographic photosensitive member, and at least one of charge means, developing means and cleaning means as process means as an unit which can removably be mounted to the image forming apparatus.

38. A process cartridge according to claim 24, wherein the process cartridge incorporates therein said electrophotographic photosensitive member, and at least developing means as process means as an unit which can removably be mounted to said image forming apparatus.

39. A process cartridge removably mountable to an image forming apparatus, said process cartridge comprising:

an electrophotographic photosensitive member; and process means acting on said electrophotographic photosensitive member, said process means including a developing sleeve used to develop a latent image formed on said electrophotographic photosensitive member, said developing sleeve being made of synthetic resin, wherein a developing blade for regulating an amount of toner adhered to said developing sleeve is made of plastic elastomer attached to a support member made of synthetic resin.

40. A process cartridge according to claim 39, wherein one of said main parts comprises a drum base around which an electrophotographic photosensitive layer is coated, and said drum base is made of synthetic resin.

41. A process cartridge according to claim 40, wherein a molded gear made of synthetic resin is provided on one end of said drum base.

42. A process cartridge according to claim 41, wherein said synthetic resin is polyacetal.

43. A process cartridge according to claim 40, wherein a drum bearing made of synthetic resin for rotatably supporting said photosensitive member is provided on one end of said drum base.

44. A process cartridge according to claim 43, wherein said drum bearing member is integrally formed with a contact spring for earthing said drum base.

45. A process cartridge according to claim 39, wherein said synthetic resin is polycarbonate (PC), polybutylene terephthalate (PBT) or polybutylene ether (PPE).

46. A process cartridge according to claim 39, wherein said synthetic resin is polycarbonate (PC), polybutylene terephthalate (PBT) or polybutylene ether (PPE).

47. A process cartridge according to claim 46, wherein a sleeve gear made of synthetic resin is provided on one end of said developing sleeve.

48. A process cartridge according to claim 39, wherein one of said main parts is a cleaning blade for removing toner remaining on said electrophotographic photosensitive member, and said cleaning blade is made of plastic elastomer and is attached to a support member made of synthetic resin.

49. A process cartridge according to claim 39, where said process cartridge incorporates therein said electrophotographic photosensitive member, and charge means, developing means or cleaning means as process means as a unit which can removably be mounted to the image forming apparatus.

50. A process cartridge according to claim 39, wherein said process cartridge incorporates therein said electrophotographic photosensitive member, and at least one of charge means, developing means and cleaning means as process means as an unit which can removably be mounted to the image forming apparatus.

51. A process cartridge according to claim 39, wherein the process cartridge incorporates therein said electrophotographic photosensitive member, and at least developing means as process means as an unit which can removably be mounted to said image forming apparatus.

52. An image forming apparatus to which a process cartridge is removably mountable and which is adapted to form an image on a recording medium, said image forming apparatus comprising:

(a) mounting means for removably mounting a process cartridge, the process cartridge comprising an electrophotographic photosensitive member including a drum base made of synthetic resin around which an electrophotographic photosensitive layer is coated, and process means acting on the electrophotographic photosensitive member, the process means including (i) a charge roller having a shaft made of synthetic resin and a roller portion made of conductive plastic elastomer, for charging the electrophotographic photosensitive member, (ii) a developing sleeve made of synthetic resin and developing a latent image formed on the electrophotographic photosensitive member, and (iii) a developing blade for regulating an amount of toner adhered to the developing sleeve, the developing blade being made of plastic elastomer attached to a support member made of synthetic resin; and (b) convey means for conveying the recording medium.

53. An image forming apparatus to which a process cartridge is removably mountable and which is adapted to form an image on a recording medium, said image forming apparatus comprising:

(a) mounting means for removably mounting a process cartridge, the process cartridge comprising (i) an electrophotographic photosensitive member including a drum base made of synthetic resin around which an electrophotographic photosensitive layer is coated and a drum bearing made of synthetic resin for rotatably supporting the electrophotographic photosensitive member and provided on one end of the drum base, wherein the drum bearing is integrally formed with a contact spring for earthing the drum base, and (ii) process means acting on the electrophotographic photosensitive member; and (b) convey means for conveying the recording medium.

54. An image forming apparatus to which a process cartridge is removably mountable and which is adapted to form an image on a recording medium, said image forming apparatus comprising:

(a) mounting means for removably mounting a process cartridge, the process cartridge comprising an electrophotographic photosensitive member and process means acting on the electrophotographic photosensitive member, the process means including a charge roller for charging the electrophotographic photosensitive member, the charge roller having a shaft made of synthetic resin and a roller portion made of conductive plastic elastomer; and (b) convey means for conveying the recording medium.

55. An image forming apparatus to which a process cartridge is removably mountable and which is adapted to form an image on a recording medium, said image forming apparatus comprising:

(a) mounting means for removably mounting a process cartridge, the process cartridge including an electrophotographic photosensitive member and process means acting on the electrophotographic photosensitive member, the process means including a developing sleeve used to develop a latent image formed on the electrophotographic photosensitive member, the developing sleeve being made of synthetic resin, wherein a developing blade for regulating an amount of toner adhered to the developing sleeve is made of plastic elastomer attached to a support member made of synthetic resin; and (b) convey means for conveying the recording medium.

* * * * *

UNITED STATES PATENT AND TRADEMARK OFFICE

CERTIFICATE OF CORRECTION

PATENT NO. : 5,550,617

DATED : August 27, 1996

INVENTOR(S) : KAZUYOSHI ODAGAWA, ET AL.

It is certified that error appears in the above-identified patent and that said Letters Patent is hereby corrected as shown below:

Under "ABSTRACT":

Line 3, "phtosensitive" should read --photosensitive--.

IN THE DISCLOSURE:

COLUMN 2:

Line 22, "10" should be deleted; and
Line 49, "be" should be deleted.

COLUMN 3:

Line 61, "in" should be deleted; and
Line 62, "synchronous" should read --synchronously--, and "After," should read --After--.

COLUMN 5:

(2nd Occur) Line 27, "polybutylene" should read --polyphenylene--;
Line 56, "polybu-" should read --polyphenylene--;
Line 57, "tylene" should be deleted; and
Line 65, "carting" should read --earthing--.

UNITED STATES PATENT AND TRADEMARK OFFICE

CERTIFICATE OF CORRECTION

PATENT NO. : 5,550,617

DATED : August 27, 1996

INVENTOR(S) : KAZUYOSHI ODAGAWA, ET AL.

It is certified that error appears in the above-identified patent and that said Letters Patent is hereby corrected as shown below:

COLUMN 6:

Line 17, "FIGS. 6A" should read --FIG. 6A--; and
Line 66, "charge" should read --charged--.

COLUMN 7:

(2nd occur) Line 18, "polybutylene" should read --polyphenylene--;
Line 39, "polybutylene" should read --polyphenylene--;
Line 41, "rotated" should read --rotate--; and
Line 64, "polybutylene" should read --polyphenylene--.

COLUMN 8:

Line 66, "polybutylene" should read --polyphenylene--.

COLUMN 9:

Line 13, "same" should read --the same--.

COLUMN 10:

Line 66, "flame 12b," should read --frame 12b,--.

UNITED STATES PATENT AND TRADEMARK OFFICE

CERTIFICATE OF CORRECTION

PATENT NO. : 5,550,617

DATED : August 27, 1996

INVENTOR(S) : KAZUYOSHI ODAGAWA, ET AL.

It is certified that error appears in the above-identified patent and that said Letters Patent is hereby corrected as shown below:

COLUMN 11:

Line 5, "frame 12d" should read --frame 12b--; and
Line 11, "the a decrease" should read --a decrease in--.

COLUMN 12:

Line 54, "be" (first occurrence) should be deleted;
Line 57, "be" (first occurrence) should be deleted;
Line 59, "be" (first occurrence) should be deleted;
Line 62, "be" (first occurrence) should be deleted; and
Line 67, "be" (first occurrence) should be deleted.

COLUMN 13:

Line 4, "be" (first occurrence) should be deleted;
Line 7, "be" (first occurrence) should be deleted;
Line 11, "be" should be deleted;
Line 14, "apparatuses" should read --apparatus--;
Line 27, "the a decrease" should read --a decrease in--; and
Line 52, "polybutylene" should read --polyphenylene--.

COLUMN 14:

Line 11, "an" should read --a--;
Line 16, "an" should read --a--;

UNITED STATES PATENT AND TRADEMARK OFFICE

CERTIFICATE OF CORRECTION

PATENT NO. : 5,550,617

DATED : August 27, 1996

INVENTOR(S) : KAZUYOSHI ODAGAWA, ET AL.

It is certified that error appears in the above-identified patent and that said Letters Patent is hereby corrected as shown below:

Line 22, "rotatable" should read --rotatably--;
Line 31, "polybutylene" should read --polyphenylene--;
Line 48, "amount" should read --an amount--;
Line 50, "rosin" should read --resin--; and
Line 53, "polybutylene" should read --polyphenylene--.

COLUMN 15:

Line 5, "an" should read --a--;
Line 10, "an" should read --a--;
Line 39, "polybutylene" should read --polyphenylene--;
Line 47, "polybutylene" should read --polyphenylene--; and
Line 52, "amount" should read --an amount--.

COLUMN 16:

Line 3, "an" should read --a--;
Line 8, "an" should read --a--;
Line 41, "polybutylene" should read --polyphenylene--;

UNITED STATES PATENT AND TRADEMARK OFFICE

CERTIFICATE OF CORRECTION

PATENT NO. : 5,550,617 Page 5 of 5

DATED : August 27, 1996

INVENTOR(S) : KAZUYOSHI ODAGAWA, ET AL.

It is certified that error appears in the above-identified patent and that said Letters Patent is hereby corrected as shown below:

Line 44, "polybutylene" should read --polyphenylene--; and
Line 63, "an" should read --a--.

Signed and Sealed this

Seventeenth Day of February, 1998

*Attest:*

*Attesting Officer*

BRUCE LEHMAN

*Commissioner of Patents and Trademarks*